US011299373B2

(12) United States Patent
Bersotti

(10) Patent No.: US 11,299,373 B2
(45) Date of Patent: Apr. 12, 2022

(54) BLOCKING ASSEMBLY, ELEVATOR SYSTEM

(71) Applicant: WITTUR HOLDING GMBH, Wiedenzhausen (DE)

(72) Inventor: Laura Bersotti, Treviglio (IT)

(73) Assignee: WITTUR HOLDING GMBH, Wiedenzhausen (DE)

( * ) Notice: Subject to any disclaimer, the term of this patent is extended or adjusted under 35 U.S.C. 154(b) by 240 days.

(21) Appl. No.: 16/611,708

(22) PCT Filed: May 15, 2018

(86) PCT No.: PCT/IB2018/053368
§ 371 (c)(1),
(2) Date: Nov. 7, 2019

(87) PCT Pub. No.: WO2018/211411
PCT Pub. Date: Nov. 22, 2018

(65) Prior Publication Data

US 2020/0102191 A1 Apr. 2, 2020

(30) Foreign Application Priority Data

May 16, 2017 (IT) ..... 102017000052995

(51) Int. Cl.
*B66B 13/18* (2006.01)
*B66B 13/24* (2006.01)

(52) U.S. Cl.
CPC ..... *B66B 13/18* (2013.01); *B66B 13/245* (2013.01)

(58) Field of Classification Search
CPC ..... B66B 13/18; B66B 13/245
(Continued)

(56) References Cited

U.S. PATENT DOCUMENTS 3,912,049 A * 10/1975 Holland ..... B66B 13/18 187/308
4,364,454 A 12/1982 Glaser et al.
(Continued)

FOREIGN PATENT DOCUMENTS

JP 2011173730 A 9/2011

OTHER PUBLICATIONS

International Search Report, issued in PCT/IB2018/053368 filed on May 15, 2018, dated Aug. 10, 2018.
(Continued)

*Primary Examiner* — Jeffrey Donels
(74) *Attorney, Agent, or Firm* — Cantor Colburn LLP

(57) ABSTRACT

A blocking assembly for a leaf of an elevator door includes a translation guide, a first leaf carriage mounted slidably to the translation guide between a first position and a second position, a latch connected to the translation guide and rotatable between a blocking configuration of the first leaf carriage in an intermediate position wherein the latch intercepts and blocks the carriage against the guide, and a configuration for releasing the carriage wherein the carriage is free to slide to the second position, latch return in the blocking configuration, and first coupling connected to the first leaf carriage and to the latch. When the carriage is in the first position, the first coupling is coupled together to keep the latch in the release configuration, in contrast to the action of the return. When the carriage is in the intermediate position, the first coupling is uncoupled so that the latch is moved by the return into the blocking configuration.

13 Claims, 3 Drawing Sheets

(58) Field of Classification Search
USPC ..... 187/308
See application file for complete search history.

(56) References Cited

U.S. PATENT DOCUMENTS

| | | | | |
|---|---|---|---|---|
| 4,491,213 | A * | 1/1985 | Marcroft | G07F 11/045 194/344 |
| 5,730,254 | A | 3/1998 | Nguyen | |
| 10,189,680 | B2 * | 1/2019 | Yang | B66B 13/20 |
| 10,724,278 | B2 * | 7/2020 | Provencher | E05F 15/40 |
| 2012/0168260 | A1 * | 7/2012 | Christen | B66B 13/08 187/319 |

OTHER PUBLICATIONS

Written Opinion, issued in PCT/IB2018/053368 filed on May 15, 2018, dated Aug. 10, 2018.
International Preliminary Report on Patentability, issued in PCT/IB2018/053368 filed on May 15, 2018, dated Sep. 9, 2019.
Indian Office Action for corresponding application 201917045454 filed Nov. 8, 2019; dated Jul. 6, 2021.

* cited by examiner

BLOCKING ASSEMBLY, ELEVATOR SYSTEM

CROSS-REFERENCE TO RELATED APPLICATIONS

This application is a National Phase Application of PCT International Application No. PCT/IB2018/053368, having an International Filing Date of May 15, 2018 which claims priority to Italian Application No. 102017000052995 filed May 16, 2017, each of which is hereby incorporated by reference in its entirety.

FIELD OF THE INVENTION

The present invention concerns a blocking assembly for at least one door leaf of an elevator door, and an elevator system. Prior art documents U.S. Pat. Nos. 4,364,454A and 5,730,254A show, for example, devices according to the prior art.

BACKGROUND OF THE INVENTION

A common problem in the field of elevators concerns the safety of the door closure—whether the landing doors or the car doors—when the elevator car is absent from a certain level, or when it is vertically in motion.

An accidental opening of the landing doors in the absence of the car entails a clear risk for the users of the elevator in the event of a fall, which is all the greater the higher the drop between the door concerned and the lower floor of the elevator shaft.

Also, an accidental (or intentional) opening of the car doors poses a risk for the user due to the rapid displacement of the elevator relative to the fixed structures inside the elevator shaft.

By virtue of this fundamental problem, the safety systems of the older systems assume a particular relevance, specifically those with manual opening doors; in effect, the modernization of older systems is both a duty and a social responsibility to prevent accidents and situations potentially hazardous to users.

SUMMARY OF THE INVENTION

The present invention is placed in this context, proposing to provide a door assembly of increased safety with respect to traditional systems, since it has been specifically designed to avoid forced or unauthorized opening of the doors of an elevator, and therefore to avoid any access to the compartment wherein the elevator is slidably accommodated.

Such objective is achieved by a blocking assembly and an elevator system having the feature described and claimed herein.

BRIEF DESCRIPTION OF THE FIGURES

The object of the present invention will now be described in detail, with the aid of the accompanying figures, wherein.

DETAILED DESCRIPTION

With reference to the aforementioned figures, a blocking assembly for at least one leaf of an elevator door 100, 100', in particular a car door 100, 100', is indicated collectively at reference number 1.

Figure 1:
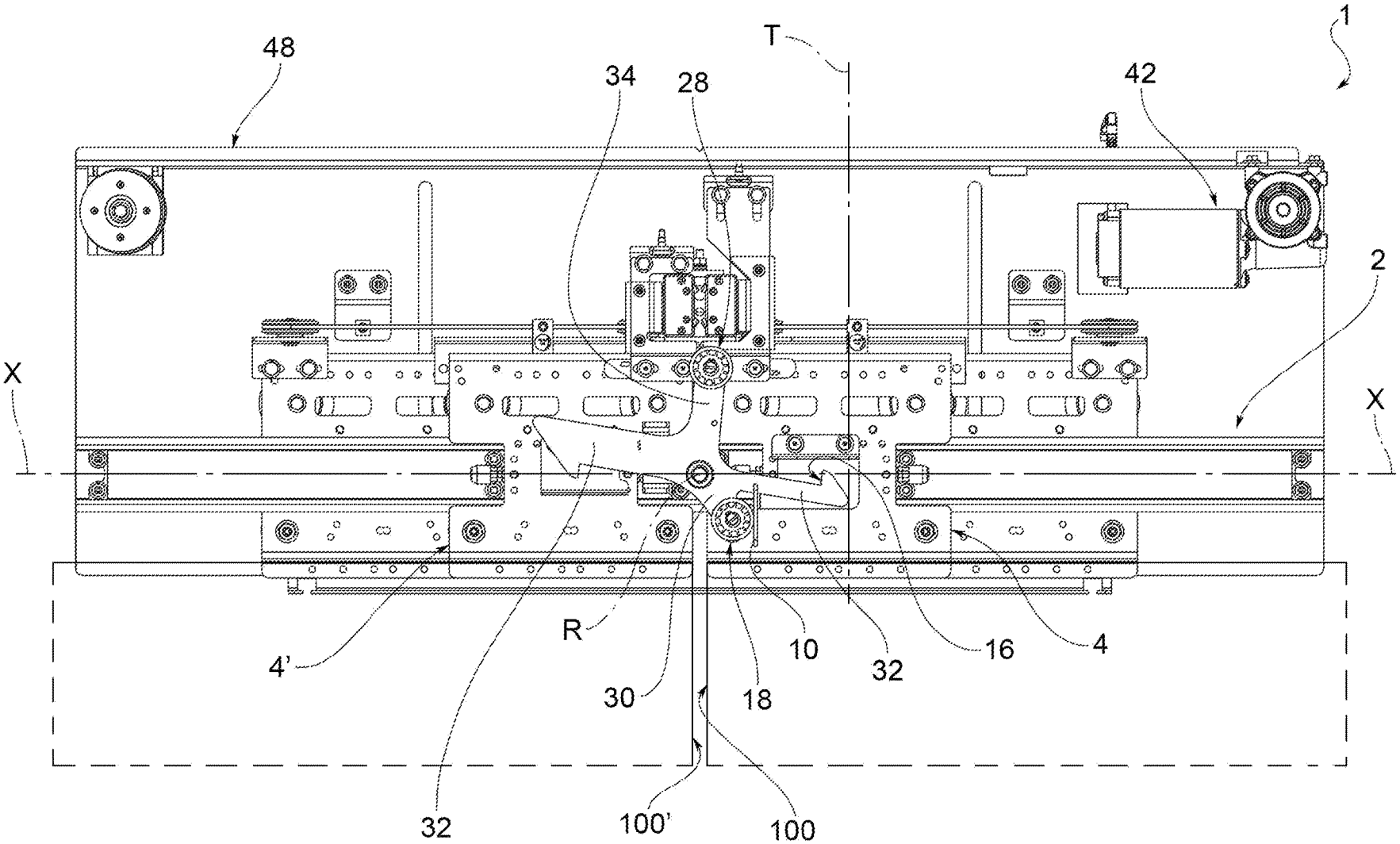
FIG. 1 shows a front view of an assembly, object of the present invention, according to a possible embodiment, wherein the door carriages are shown in a first position and wherein the elevator doors are only schematized.
Figure 2:
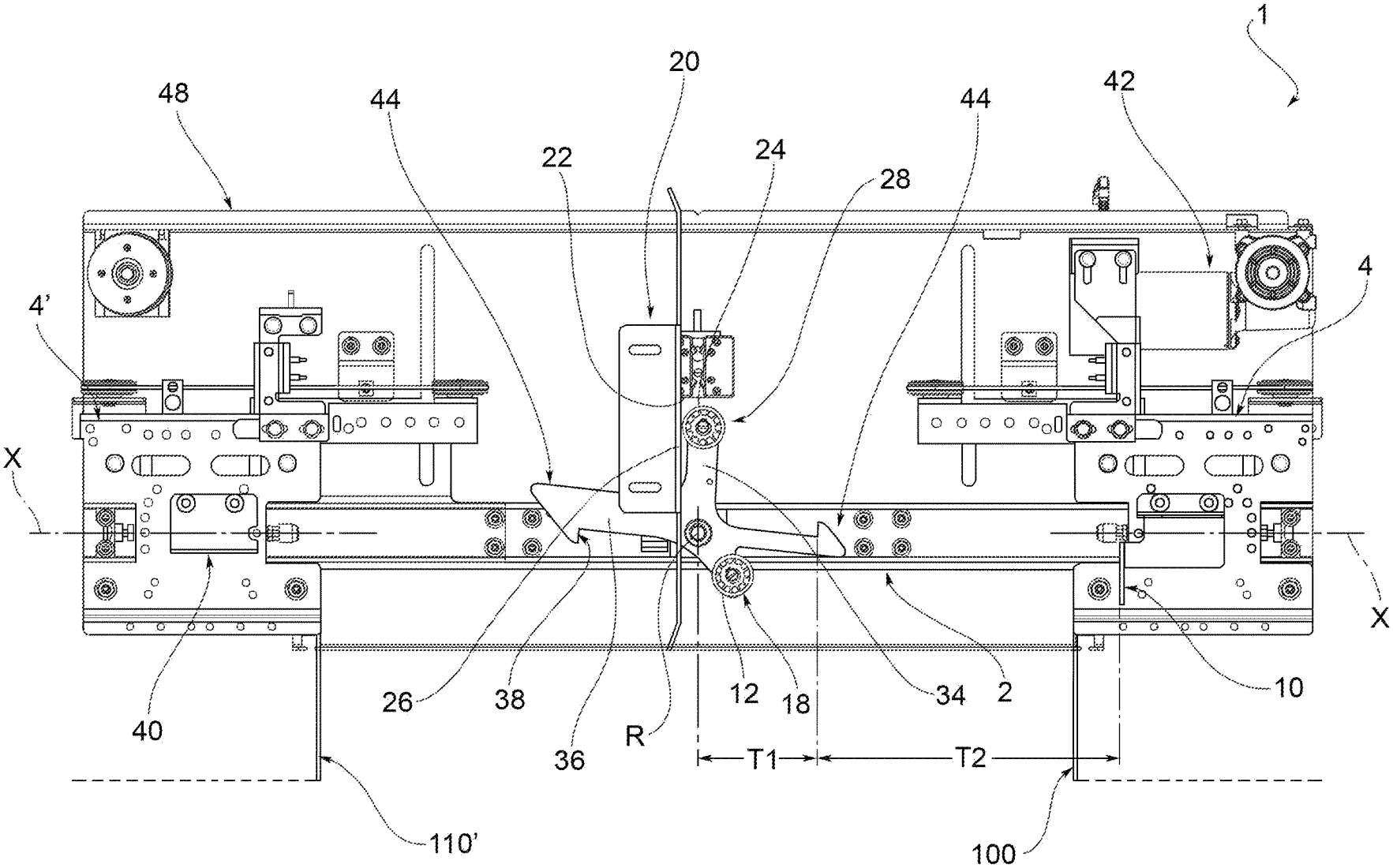
FIG. 2 represents another front view of the assembly of FIG. 1, wherein the door carriages are displaced to the ends of the guide and wherein a landing door retaining element is drawn partly overlapping the latch so as to keep it in a release configuration.

Such blocking assembly 1 comprises a translation guide 2 extending along a sliding direction X, a first leaf carriage 4 mounted slidably to the translation guide 2 between a first position (for example shown in FIG. 1) and a second position (FIG. 2), and at least one latch 6 connected to the translation guide 2.

According to one embodiment, the first position is a closed position of the passage through the door 100, 100'.

According to one embodiment, the second position is an opening (or crossing) position of the passage through the door 100, 100'. In this second position, the leaf carriage 4, 4' is at least partly offset laterally, as for example shown in FIG. 2.

According to one embodiment, the sliding of the first leaf carriage 4 (or of the pair of leaf carriages 4, 4') takes place in a sliding plane parallel to the sliding direction X.

According to one embodiment, the sliding plane is substantially parallel to at least one exposed surface of the leaf associated with the leaf carriage 4, 4'.

According to one embodiment, the blocking assembly 1 comprises an assembly crosspiece 48, for example an upper crosspiece, to which are associated at least the translation guide 2, the leaf carriage 4 and the latch 6.

According to one embodiment, the translation guide 2, the leaf carriage 4 and the latch 6 are connected to at least one leaf of the elevator door 100, 100', for example, above it.

In the variants shown, the leaf of the elevator door 100, 100' is connected and extends from the leaf carriage 4, 4'.

According to various embodiments, the leaf of the elevator door 100, 100' is screwed to or is made in one piece with the leaf carriage 4.

Although the figures show a first 4 and a second 4' leaf carriage, it should be noted that, for the purposes of the present invention, there may be only one carriage 4. In other words, the present assembly could comprise at least a pair of leaves (for example two, four or six) with a central opening such as the one illustrated, or it could comprise a side opening door (variant not illustrated).

According to one embodiment, the side opening door could comprise one or more leaves (for example two or three leaves).

According to one embodiment, the assembly 1 comprises motor means 42 for moving the at least one leaf carriage 4, 4' along the guide 2. For example, the motor means 42 are connected to the assembly crosspiece 48.

Figure 4:
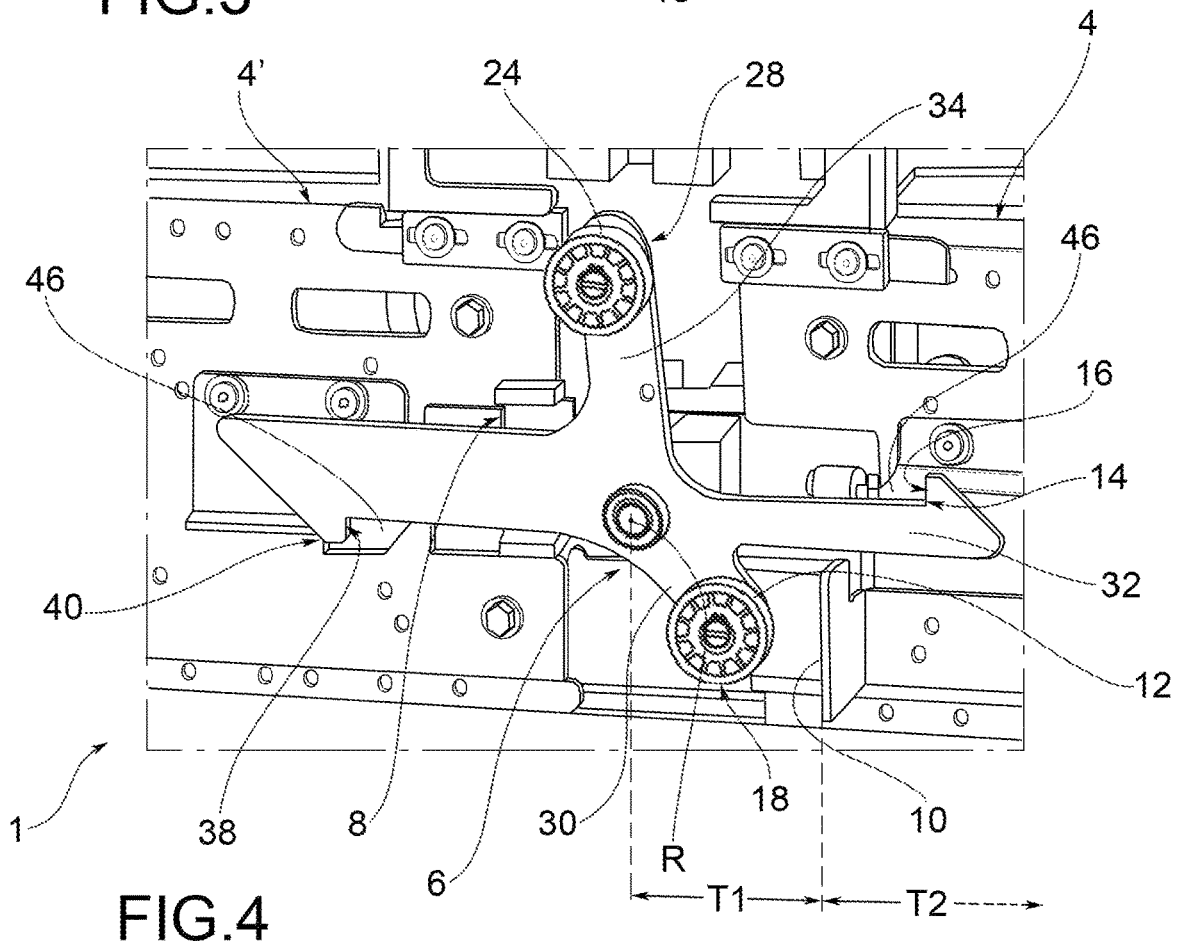
FIG. 4 schematizes the assembly of FIG. 4 in an attempt to forcibly open the elevator doors when the car doors are not aligned with the corresponding landing doors, wherein the latch is arranged in the blocking configuration and wherein the leaf carriage is in an intermediate position.

The latch is movable between a blocking configuration of such first carriage 4 in an intermediate position (for example as shown in FIG. 4) between the first position and the second position, wherein the latch 6 intercepts the first leaf carriage 4 to block it with respect to the guide 2, and a release configuration of the first carriage 4, wherein the latter is free to slide to the second position.

In other words, in the release configuration, the leaf carriage 4, 4' is mechanically released from the latch 6 and for this reason is translatable on the guide 2 to the second position.

Unless otherwise specified, the characteristics referring to the first leaf carriage 4 will be considered valid—mutatis mutandis—also to the second leaf carriage 4'.

Therefore, by way of example, also the second leaf carriage 4' is mounted to the translation guide 2, specifically slidably so as to reach a first position, an intermediate position and a second position, and vice versa (as specified for the first carriage 4).

According to one embodiment, the latch 6 is movable between a blocking configuration of the second leaf carriage 4' in the intermediate position of the latter, and a release configuration of such carriage 4' wherein it is free to slide along the translation guide 2 to its second position, in particular with a movement substantially opposite to that of the first leaf carriage 4.

According to one embodiment, the movement of the second leaf carriage 4' is substantially specular with respect to the first leaf carriage 4.

According to one embodiment, the movement of the second leaf carriage 4' is asymmetrical with respect to that of the first leaf carriage 4.

According to one embodiment, the latch 6 and the first leaf carriage 4 comprise first complementary engagement elements 14, 16, which in the blocking configuration cooperate by shape and/or by force to carry out said blocking, and which, in the release configuration, do not interact with each other or lie mutually spaced, for example, in a transverse T or orthogonal direction with respect to the sliding direction X.

According to one embodiment, the latch 6 and the second leaf carriage 4' comprise second complementary engagement elements 38, 40, which, in the blocking configuration, cooperate by shape and/or by force to carry out the aforesaid blocking, and which, in the release configuration, do not interact with each other or lie mutually spaced, e.g., in a transverse T or orthogonal direction with respect to the sliding direction X.

According to one embodiment, the movement of the latch between the aforesaid configurations is coordinated and/or simultaneous for both the leaf carriages 4, 4' in the variants which provide for a pair thereof.

According to one embodiment, one 16 of the first complementary engagement elements 14, 16 and/or one 38 of the second complementary engagement elements 38, 40 is substantially hooked 44.

According to one embodiment, one 14 of the first complementary engagement elements 14, 16 and/or one 40 of the second complementary engagement elements 38, 40 is in the form of a transverse fin 46.

According to one embodiment, at least one transverse fin 46 extends in a plane parallel to a rotation axis R of the latch 6, or in a plane wherein such axis R is housed.

The blocking assembly 1 comprises return means of the latch 6 in the blocking configuration, configured to work on the latch 6 so as to move/displace it in such configuration from the release configuration.

According to one embodiment, the return means comprise counterweight means. For example, such variant is schematized by the larger dimensions (and hence by the greater weight, with the same arm thickness) of a fourth radial arm 36 with respect to a second radial arm 32 of the latch 6.

According to one embodiment, the counterweight means could comprise a mass fixed to, or made in one piece with, a fourth radial arm 36 of the latch 6.

According to one embodiment, the return means comprise elastic means 8 (for example partly visible in FIG. 4), associated with the latch 6 to force it constantly into the blocking configuration.

According to one embodiment, the return means could comprise counterweight means and elastic means 8.

According to one embodiment, the elastic means 8 comprise at least one torsion spring.

The blocking assembly 1 comprises first coupling means 10, 12 connected to the first leaf carriage 4 and to the latch 6 so that: i) when the first leaf carriage 4 is in the first position, such means 10, 12 are coupled between them to keep the latch 6 in the release configuration, in contrast to the action of the return means; and so that ii) when the carriage is in the intermediate position between the first position and the second position (FIG. 4), such means 10, 12 are uncoupled so that the latch 6 is moved (or displaced, or forced) by the return means into the blocking configuration.

It follows that, when the leaf carriage 4 is arranged in the first position (which is, for example, a closed position of the passage through the door 100, 100'), the latch 6 is arranged in the release configuration.

Therefore, in the variants wherein the door 100, 100' is a car door, when the car moves vertically between landing doors arranged on different levels, the leaf carriage 4 travels unblocked, unless the latter undergoes a forced displacement attempt, as discussed below.

According to one embodiment, the intermediate position corresponds to a minimum stroke of the first leaf carriage 4, so as not to create in general openings between the leaf and a respective upright, or between a pair of leaves, or spatial openings wide enough to pose potential risks to a user.

More precisely, according to one embodiment, the intermediate position corresponds to a maximum stroke of the first leaf carriage 4 equal to or less than 5 cm from the first position.

According to one embodiment, for the variants which provide for a plurality of leaf carriages 4, 4' (and more precisely at least a first 4 and a second 4' leaf carriage), the overall maximum stroke is equal to or less than 5 centimeters from the first position.

According to one embodiment, the intermediate position corresponds to a maximum stroke of the leaf carriages 4, 4' of about 0.5-2.5 cm from the first position for each carriage, in the case wherein the carriages move in a mutually symmetrical way.

According to one embodiment, the latch 6 is mounted to the translation guide 2 in a rotatable manner between the aforesaid configurations about the rotation axis R.

According to one embodiment, the rotation axis R is substantially orthogonal to the sliding direction X of the first leaf carriage 4 and, more precisely, is substantially orthogonal to the sliding plane.

According to one embodiment, the latch 6 is rotatable with a maximum angle of rotation equal to or less than about 20°, for example, between about 4-12°.

The expression "angle of rotation" means the angular path traveled by the latch 6 between the blocking configuration and the release configuration.

According to one embodiment, the first coupling means 10, 12 comprise a first abutment surface 10 integral with the first leaf carriage 4, and a second abutment surface 12 connected to the latch 6. Such abutment surfaces 10, 12 are therefore in abutment in coupling, and are spaced in decoupling.

According to one embodiment, the second abutment surface 12 is delimited by a first rolling means 18 mounted to the latch 6, for example in an idle manner.

According to one embodiment, the complementary engagement elements 14, 16 and the abutment surfaces 10, 12 are arranged/offset along the sliding direction X so that—starting from the first position towards the second position—the uncoupling of the first coupling means 10, 12 and the blocking configuration of the latch 6 occur sequentially in that order.

It follows that the first leaf carriage 4 has been designed to be movable from the first position to the intermediate position for a first section T1 (or initial section) during which the first coupling means 10, 12 disengage from each other, and wherein a second section T2 (or subsequent section) is free and accessible for the sliding of such carriage only if the conditions exist for the door to open safely, for example only if the car door and the landing door are substantially aligned with each other, specifically, in the vertical direction.

In other words, starting from the first position, the sliding path of the first leaf carriage 4 along the translation guide 2 is divided into a first section T1 (or initial section, for example, see FIG. 2), and a second section T2 (or subsequent section): when the first leaf carriage 4 is moved forcibly in the first section up to the intermediate position (for example through a manual action, for example when the elevator car is moving or when the car door is misaligned with respect to the landing door), such forced movement will decouple the first coupling means 10, 12, so that the latch 6 will be arranged in the blocking configuration by the return means. The first leaf carriage 4 will therefore be prevented from reaching the second section T2.

According to one embodiment, the first leaf carriage 4 is the carriage of a car door.

According to one embodiment, the assembly 1 comprises at least one retaining element 20 of the latch 6 fixed to at least one landing door.

According to one embodiment, the retaining element 20 comprises a bracket or a blade 26.

According to one embodiment, the blocking assembly 1 comprises second coupling means 22, 24, connected to the latch 6 and comprising the retaining element 20 so that, when such second means 22, 24 are coupled together (as shown for example in FIG. 2), the latch 6 is kept in the release configuration, in contrast to the action of the return means and also when the first coupling means 10, 12 are mutually uncoupled.

In other words, since part of the second coupling means 22, 24 is arranged at the landing door, where the movement of the first leaf carriage 4 along the translation guide 2 must also be allowed in the second section T2 (after the intermediate position has been surpassed), such second means 22, 24 provide for keeping the latch 6 in the release configuration, and therefore allow the carriage 4 to also travel the second section T2 of its sliding path (e.g., allowing a lateral displacement of the leaf).

In accordance with one embodiment, the retaining element 20 comprises a bracket or a blade 26 fixed in such a way that the second coupling means 22, 24 are coupled together (FIG. 2) when the car door and the landing door are substantially aligned, specifically in a vertical direction.

Figure 3:
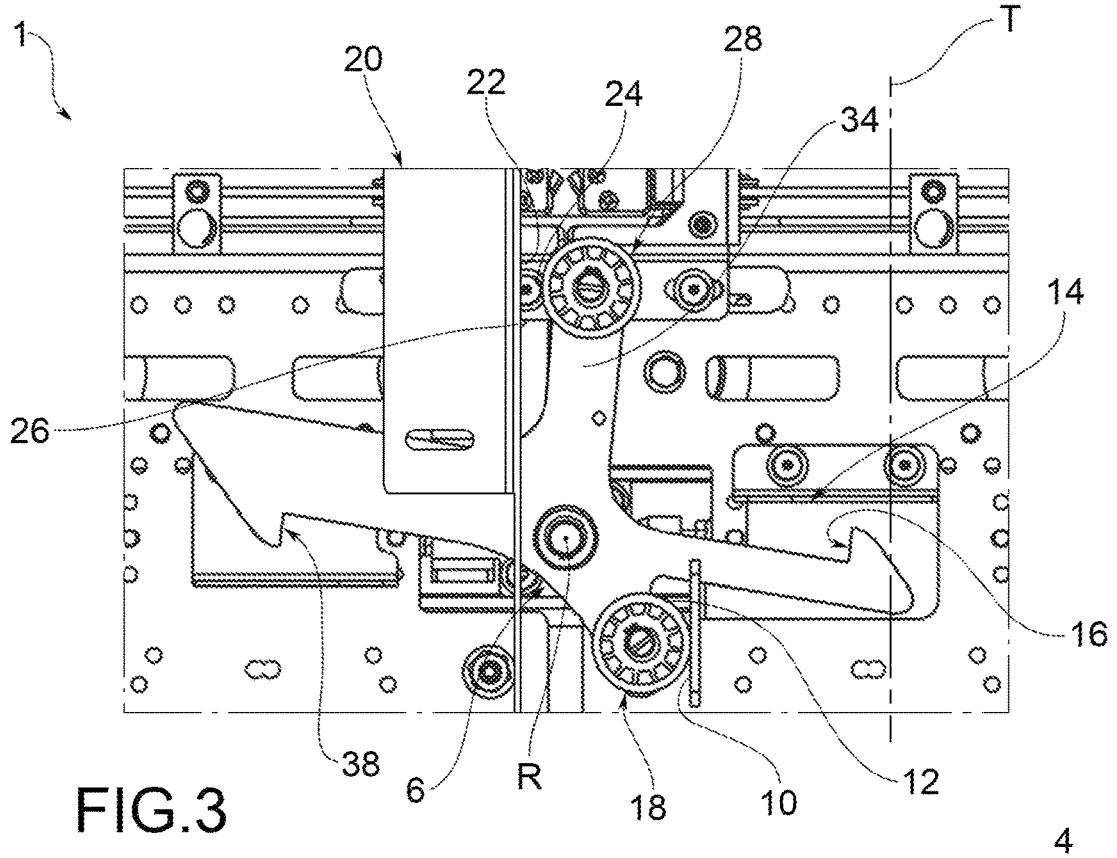
FIG. 3 illustrates an enlargement of the area of the latch of FIG. 2, wherein the door carriages are in the first position, and wherein the mechanical parts are positioned in a way corresponding to the configuration assumed during the vertical movement of the car.

According to one embodiment, when the first coupling means 10, 12 are coupled to keep the latch 6 in the release configuration (see, for example, FIG. 3), the second coupling means 22, 24 are uncoupled or at a distance, for example, so as not to cause banging or noise during the vertical movement of the leaf carriage 4 with the car thereof.

Such condition is not observed in many known solutions wherein, contrary to what is discussed in this embodiment, the second coupling means reach mutual abutment at each floor generating noise at each landing door.

By way of example, in the arrangement shown in the earlier document U.S. Pat. No. 4,364,454A (see FIG. 8 of such document), the cam follower (indicated at number 40) can do nothing other than bump into the cams (referred to in the references 45, 46, 47) on each floor, as in such system the latch (number 38) travels closed and may only be opened on the floor to allow access to the car.

According to one embodiment, the second coupling means 22, 24 comprise a third abutment surface 24, integral with the retaining element 20, and a fourth abutment surface 22 connected to the latch 6. Such surfaces 22, 24 therefore are in abutment in coupling, and are optionally spaced in decoupling.

According to one embodiment, the fourth abutment surface 24 is delimited by a second rolling means 28 mounted to the latch 6, for example, in an idle manner.

According to one embodiment, the landing door is a manual opening door.

According to one embodiment, the landing door is a sliding or hinged door.

According to one embodiment, the latch 6 extends in a plane substantially orthogonal to the axis of rotation R.

According to one embodiment, the latch 6 comprises a plurality of radial arms 30, 32, 34, 36 which, in particular, diverge away from the axis of rotation R.

According to one embodiment, a first radial arm 30 bears the second abutment surface 12. For example, the first rolling means 18 could be mounted to such first arm 30.

According to one embodiment, a second radial arm 32 delimits one 16 of the optional complementary engagement elements 14, 16.

According to one embodiment, a third radial arm 34 bears the optional fourth abutment surface 24. For example, the second rolling means 28 could be mounted to such third arm 34.

According to one embodiment, a fourth radial arm 36 delimits one 38 of a pair of optional second complementary engagement elements 38, 40, which, in the blocking configuration, cooperates by shape and/or by force with another complementary engagement element 40 to lock the second leaf carriage 4' in the first position.

The object of the present invention is moreover an elevator system comprising a plurality of landing doors arranged on different levels and a car door, movable vertically, to be placed in alignment with each landing door and comprising a blocking assembly 1 according to any one of the preceding variants, at least one retaining element 20 of the latch 6 being attached to at least one landing door (for example at all such doors).

Innovatively, the assembly object of the present invention makes it possible to solve the drawbacks reported with respect to the prior art.

Advantageously, the assembly object of the present invention allows automatic car doors to be coupled with manual landing doors in a simple and versatile way.

Advantageously, the assembly object of the present invention has been conceived for the modernization of existing systems, by virtue of its constructive simplicity and reliability.

Advantageously, the assembly object of the present invention has a mainly mechanical operation and is therefore substantially immune to electronic malfunctions.

Advantageously, the assembly object of the present invention makes it possible to carry out a progressive intervention on the various safety devices on the leaf carriages.

Advantageously, the assembly object of the present invention is able to precisely determine the location of the car with respect to the landing doors, and to control the safety devices required by the circumstances.

Advantageously, the assembly object of the present invention has an extremely silent movement, both during the movement of the car and during the translation of the carriage.

Advantageously, the assembly object of the present invention employs a simple retaining element that is easily implementable in any system.

Advantageously, the assembly object of the present invention has been designed to effect modernizations of existing systems with minimal investment costs. In effect, by replacing a blocking assembly to be modernized with the assembly of the present invention in the car, and by fixing a plurality of retaining elements at the landing doors, it is possible to drastically reduce the costs for this type of implementation of safety measures.

Advantageously, the assembly object of the present invention has been designed to operate without dynamic coupling between the car door and the landing doors. More precisely, since a variant of the present invention provides for manually operated landing doors, the latch at the landing doors may be released with a series of static abutments fixed to the different levels in the elevator shaft.

To the embodiments of the aforesaid assembly and system, one skilled in the art, in order to meet specific needs, may make variants or substitutions of elements with other functionally equivalent ones.

These variants are also contained within the scope of protection as defined by the following claims.

Furthermore, each variant described as belonging to a possible embodiment may be achieved independently of the other described variants.

The invention claimed is:

1. A blocking assembly for at least one leaf of an elevator door comprising:

a translation guide extending along a sliding direction;

at least one first leaf carriage, slidably mounted to the translation guide between a first position and a second position;

at least one latch connected to the translation guide and movable between a blocking configuration of said first leaf carriage in an intermediate position between the first position and the second position, wherein said latch intercepts and blocks the first leaf carriage with respect to said guide, and a release configuration of said first leaf carriage, wherein the first leaf carriage is free to slide to the second position;

return means comprising elastic means and/or counterweight means, of the latch in the blocking configuration;

first coupling means connected to the first leaf carriage and to the latch so that:

i) when the first carriage is in the first position, said coupling means are mutually coupled to keep the latch in the release configuration, in contrast to an action of the return means;

ii) when the carriage is in the intermediate position, said coupling means are uncoupled so that the latch is moved by the return means to the blocking configuration;

a second leaf carriage mounted to the translation guide, wherein the latch is movable between a blocking configuration of said second leaf carriage in an intermediate position of the second leaf carriage, and a release configuration of said second leaf carriage in which the second leaf carriage is free to slide along the translation guide to a second position with a movement opposite the movement of the first leaf carriage; wherein the latch and the first leaf carriage comprise first complementary engagement elements which, in the blocking configuration, cooperate to carry out said blocking, and, in the release configuration, do not interact with each other or lie mutually spaced in a transverse or orthogonal direction with respect to the sliding direction; and wherein the latch and the second leaf carriage comprise second complementary engagement elements, which, in the blocking configuration, cooperate to carry out the aforesaid blocking, and, in the release configuration, do not interact with each other or lie mutually spaced, in a transverse or orthogonal direction with respect to the sliding direction.

2. The blocking assembly of claim 1, wherein the intermediate position corresponds to a maximum stroke of the first leaf carriage, or a maximum total stroke of a plurality of leaf carriages, equal to or smaller than 5 centimeters from the first position.

3. The blocking assembly of claim 1, wherein the first coupling means comprise a first abutment surface integral with the first leaf carriage, and a second abutment surface connected to the latch, said surfaces being in abutment in said coupling and spaced in said uncoupling.

4. The blocking assembly of claim 3, wherein the second abutment surface is delimited by a first rolling means mounted idle to the latch.

5. The blocking assembly of claim 1, wherein the complementary engagement elements and the abutment surfaces are offset along the sliding direction so that, starting from the first position towards the second position, the uncoupling of the first coupling means and the blocking configuration of the latch occur sequentially in that order.

6. The blocking assembly of claim 1, wherein, starting from the first position, the sliding path of the first leaf carriage along the translation guide is divided into a first section and into a second section, and wherein, when the first leaf carriage is forcefully moved in the first section, for example by a manual action, such a forced movement uncouples the first coupling means, so that the latch is arranged in the blocking configuration by the return means, and the first leaf carriage is thus prevented from reaching the second section.

7. The blocking assembly of claim 1, wherein the first leaf carriage is the carriage of a car door, and wherein said assembly comprises:

at least one retaining element of the latch, such as a bracket or a blade, attached at least at a landing door;

second coupling means connected to the latch and comprising the retaining element so that when said second coupling means are coupled together, the latch is kept in the release configuration, in contrast to the action of the return means and also when the first coupling means are uncoupled.

8. The blocking assembly of claim 7, wherein the retaining element comprises a bracket or a blade fixed in such a way that the second coupling means are coupled together when the car door and the landing door are substantially aligned in a vertical direction.

9. The blocking assembly of claim 7, wherein, when the first coupling means are coupled to keep the latch in the release configuration, the second coupling means are uncoupled or at a distance so as not to generate collisions or noise during a vertical movement of the carriage with the car thereof.

10. The blocking assembly of claim 7, wherein the second coupling means comprise a third abutment surface integral with the retaining element, and a fourth abutment surface connected to the latch, said surfaces being in abutment in said coupling and spaced in said uncoupling.

11. The blocking assembly of claim 7, wherein the landing door is a door with manual opening, sliding or hinged.

12. The blocking assembly of claim 1, wherein the latch extends in a plane substantially orthogonal to an axis of rotation and comprises:

a first radial arm bearing the second abutment surface;

a second radial arm delimiting one of optional complementary engagement elements;

a third radial arm bearing an optional fourth abutment surface;

a fourth radial arm delimiting one of a pair of optional second complementary engagement elements, which, in the blocking configuration, cooperates with another complementary engagement element to lock the second leaf carriage in the first position.

13. An elevator system comprising a plurality of landing doors arranged on different levels and a car door movable vertically to be placed aligned with each landing door and comprising a blocking assembly, the blocking assembly comprising:

a translation guide extending along a sliding direction;

at least one first leaf carriage, slidably mounted to the translation guide between a first position and a second position;

at least one latch connected to the translation guide and movable between a blocking configuration of said first leaf carriage in an intermediate position between the first position and the second position in which said latch intercepts and blocks the first leaf carriage with respect to said guide, and a release configuration of said first leaf carriage, wherein the first leaf carriage is free to slide to the second position;

return means comprising elastic means and/or counterweight means, of the latch in the blocking configuration;

first coupling means connected to the first leaf carriage and to the latch;

a second leaf carriage mounted to the translation guide, wherein the latch is movable between a blocking configuration of said second leaf carriage in an intermediate position of the second leaf carriage, and a release configuration of said second leaf carriage in which the second leaf carriage is free to slide along the translation guide to a second position with a movement opposite the movement of the first leaf carriage; wherein the latch and the first leaf carriage comprise first complementary engagement elements which, in the blocking configuration, cooperate to carry out said blocking, and, in the release configuration, do not interact with each other or lie mutually spaced in a transverse or orthogonal direction with respect to the sliding direction; and wherein the latch and the second leaf carriage comprise second complementary engagement elements, which, in the blocking configuration, cooperate to carry out the aforesaid blocking, and, in the release configuration, do not interact with each other or lie mutually spaced in a transverse or orthogonal direction with respect to the sliding direction, at least one retaining member of the latch being attached at least at one landing door.

* * * * *